United States Patent [19]

Bailey

[11] Patent Number: 4,598,757

[45] Date of Patent: Jul. 8, 1986

[54] BONDED SAND SPRUE CUP

[75] Inventor: Francis V. Bailey, Racine, Wis.

[73] Assignee: Outboard Marine Corporation, Waukegan, Ill.

[21] Appl. No.: 634,599

[22] Filed: Jul. 26, 1984

[51] Int. Cl.[4] ..... B22D 33/04

[52] U.S. Cl. ..... 164/137; 164/364; 164/412

[58] Field of Search ..... 164/34, 35, 133, 137, 164/349, 412, 363, 364; 249/108, 134, 205

[56] References Cited

U.S. PATENT DOCUMENTS

| | | | |
|---|---|---|---|
| 1,657,952 | 1/1928 | Zoda | 164/135 |
| 2,198,498 | 4/1940 | Hagemeyer | 164/412 |
| 2,269,455 | 1/1942 | Hagemeyer | 164/412 |
| 2,784,467 | 3/1957 | Gans, Jr. | 164/133 |
| 2,835,007 | 5/1958 | Hoefer | 164/134 |
| 2,845,669 | 8/1958 | Hackett et al. | 164/137 |
| 3,526,266 | 9/1970 | Snelling | 164/34 |
| 3,841,846 | 10/1974 | Larsen et al. | 164/349 |
| 3,844,337 | 10/1974 | Bessett et al. | 164/412 |
| 4,154,285 | 5/1979 | Yamasaki | 164/133 |
| 4,506,813 | 3/1985 | Dughan | 164/137 |

*Primary Examiner*—Nicholas P. Godici
*Assistant Examiner*—Richard K. Seidel
*Attorney, Agent, or Firm*—Michael, Best & Friedrich

[57] ABSTRACT

A disposable sprue cup for use in a metal casting process using a mold pattern embedded in unbound process sand having a grain size, the disposable sprue cup being made of bonded sand having a grain size substantially equal to the grain size of the process sand and having a binder that breaks down under the heat of resident metal remaining in the cup after the casting process is completed.

13 Claims, 2 Drawing Figures

BONDED SAND SPRUE CUP

BACKGROUND OF THE INVENTION

The invention relates to sprue cups used in metal casting processes, and, more particularly, to such sprue cups that are disposable.

Sprue cups used in metal casting processes can be either permanent, i.e., made of metal, or disposable. Permanent or metal sprue cups last indefinitely, but they have several disadvantages. Because they are permanent, they must be retrieved for reuse after each casting process is completed. Because they are made of metal, they absorb a great deal of heat, and therefore the molten metal poured into the sprue cup must be heated to a higher temperature than would be necessary if the sprue cup were made of a non-metal. Furthermore, metal sprue cups must be kept coated with a refractory coating, and this necessitates frequent recoating of the sprue cup. Finally, permanent sprue cups require general maintenance so that they are in a suitable condition for use.

Disposable sprue cups, on the other hand, do not have these disadvantages. Disposable sprue cups are typically made of a ceramic material or a fibrous refractory material. Disposable sprue cups generally last through only one casting process and therefore need not be retrieved, recoated, or maintained for reuse. Additionally, ceramic and fibrous refractory materials absorb relatively little heat, so that the molten metal need not be heated higher than is necessary to pour the casting.

The major disadvantage of known disposable sprue cups is that they break down into the process sand of the casting process. As a result, the process sand must be screened out in order to remove either refractory fibers or pieces of ceramic material. Otherwise, the process sand would become contaminated and would not produce satisfactory castings.

Attention is directed to the following U.S. patents:

Zoda U.S. Pat. No. 1,657,952, issued Jan. 31, 1928;

Gans, Jr. U.S. Pat. No. 2,784,467, issued Mar. 12, 1957;

Hoefer U.S. Pat. No. 2,835,007, issued May 20, 1958;

Snelling U.S. Pat. No. 3,526,266, issued Sept. 1, 1970;

Larsen et al. U.S. Pat. No. 3,841,846, issued Oct. 15, 1974; and

Yamasaki U.S. Pat. No. 4,154,285, issued May 15, 1979.

SUMMARY OF THE INVENTION

The invention provides a disposable sprue cup for use in a metal casting process, the process using a mold pattern embedded in unbound process sand having a grain size and the process including the pouring of molten metal into the sprue cup, the disposable sprue cup comprising bonded sand including unbound sand having a grain size substantially equal to the grain size of the process sand and a binder that remains intact until after the pouring is completed and then breaks down under the heat received during the casting process.

The invention also provides a disposable sprue cup for use in a metal casting process, the process using a mold pattern embedded in unbound process sand having a grain size and the process including the pouring of molten metal into the sprue cup, the disposable sprue cup having walls of a predetermined thickness and comprising bonded sand including unbound sand having a grain size substantially equal to the grain size of the process sand and a binder that forms a predetermined percentage of the bonded sand. The wall thickness and the binder percentage are such that the bonded sand remains intact until after the pouring is completed and then breaks down under the heat received during the casting process, thereby leaving essentially unbound sand that does not contaminate the unbound process sand.

In one embodiment, the cup comprises an enlarged cup portion adapted to receive molten metal, and an elongated neck portion extending downwardly from the cup portion when the sprue cup is oriented for casting and adapted to be attached to the sprue of a mold pattern such that molten metal received in the cup portion flows within the neck portion to the sprue of the mold pattern.

In one embodiment, the neck portion has a cross-sectional area, and the cup portion includes a main portion having a cross-sectional area substantially greater than the cross-sectional area of the neck portion and a tapered portion integrally connected between the main portion and the neck portion.

In one embodiment, the elongated neck portion includes a lower end and is adapted to be attached to the sprue of a foam mold pattern by extending the sprue through the lower end into the neck portion.

In one embodiment, the metal casting process includes the pouring of molten metal into the sprue cup, and the binder remains intact until after the pour is complete.

In one embodiment, the neck portion has a length such that, when metal is poured into the sprue cup and the foam of the sprue melts beneath the lower end of the neck portion, the flow of metal adjacent the unbound process sand is laminar.

The invention also provides a casting process comprising the steps of fabricating a disposable sprue cup made of bonded sand including a binder and unbound sand having a grain size, the sprue cup including an enlarged cup portion adapted to receive molten metal and an elongated neck portion extending downwardly from the cup portion when the sprue cup is oriented for casting, attaching the sprue cup to a foam mold pattern having a sprue by extending the sprue into the neck portion of the sprue cup, embedding the foam mold pattern and a portion of the attached sprue cup in unbound process sand, and pouring molten metal into the sprue cup so that the molten metal received in the cup portion flows within the neck portion to the sprue of the mold pattern, whereby, after completion of the pouring step, the binder of the sprue cup disintegrates in response to heat received during the casting process, thereby leaving essentially unbound sand that does not contaminate the unbound process sand.

In one embodiment, the pouring step includes pouring at a predetermined rate molten metal having a predetermined temperature into the sprue cup so that the metal flowing within the neck portion melts the sprue of the mold pattern, the attaching step includes extending a predetermined length of the sprue into the neck portion of the sprue cup, and the fabricating step includes fabricating the sprue cup such that the neck portion has a length. The length of the neck portion, the length of the sprue extended into the neck portion, and the temperature and pouring rate of the metal are such that, when the foam of the sprue melts beneath the lower end of the neck portion in response to the pouring step, the flow of metal adjacent the unbound process sand is laminar.

A principal feature of the invention is to provide a disposable sprue cup made of bonded sand having a grain size substantially equal to the grain size of the process sand and having a binder that breaks down under the heat of resident metal remaining in the cup after the casting process is completed. Because the bonded sand has a grain size substantially equal to the grain size of the process sand, when the sprue cup breaks down, the unbound sand that remains mixes with the unbound process sand and does not contaminate the process sand.

Another principal feature of the invention is that the breaking down of the bonded sand sprue cup of the invention helps to replace the process sand that is normally lost during the casting process, especially during removal of the casting from the sand.

Other features and advantages of the invention will become apparent to those skilled in the art upon review of the following detailed description, drawings, and claims.

Figure 1:
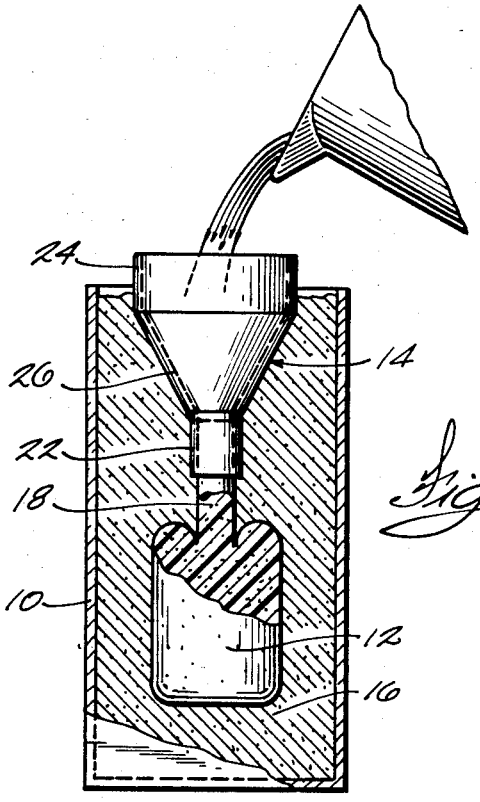
FIG. 1 illustrates a casting process using a disposable sprue cup embodying the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in FIG. 1 is a mold flask 10 containing a foam mold pattern 12 and a sprue cup 14 embedded in compacted unbound process or foundry sand 16. The sprue cup 14 is attached to the sprue 18 of the mold pattern 12. Also illustrated in FIG. 1 is molten metal being poured into the sprue cup 14.

Figure 2:
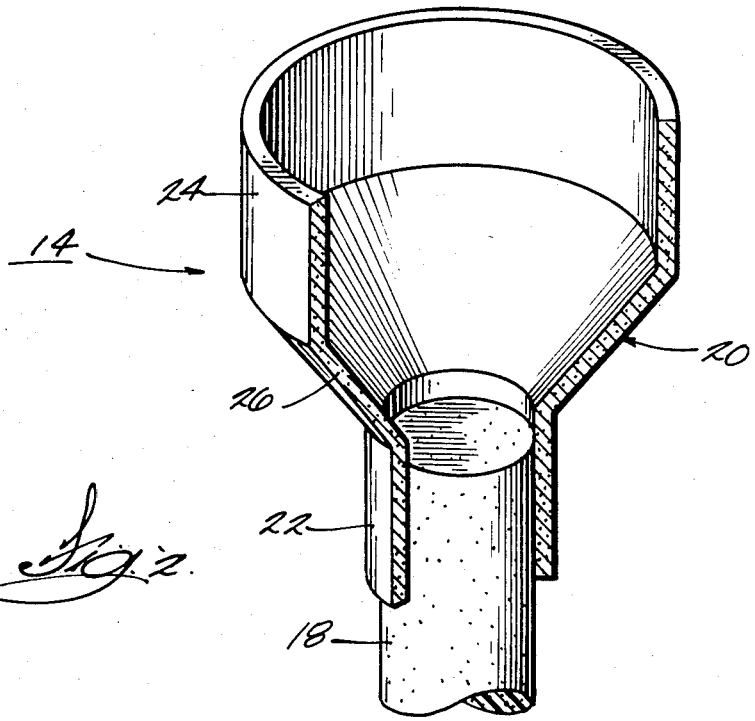
FIG. 2 is an enlarged cross-sectional view of a disposable sprue cup embodying the invention.

As best shown in FIG. 2, the sprue cup 14 comprises an enlarged cup portion 20 adapted to receive molten metal and an elongated neck portion 22 extending downwardly from the cup portion 20 and adapted to be attached to the sprue 18 of the mold pattern 12, as illustrated. The enlarged cup portion 20 includes a main portion 24 having an inside diameter substantially greater than the inside diameter of the neck portion 22 and a tapered portion 26 integrally connected between the main portion 24 and the neck portion 22.

The sprue cup 14 is attached to the sprue 18 of the mold pattern 12 by extending the sprue 18 through the lower end of the neck portion 22 into the neck portion 22, as shown in FIG. 2. In the illustrated construction, the sprue 18 is cylindrical and fits snuggly into the neck portion 22 of the sprue cup 14.

In a casting process utilizing the sprue cup 14, after the mold pattern 12 and attached sprue cup 14 are surrounded by compacted process sand 16 as shown in FIG. 1, molten metal is poured into the cup portin 20 of the sprue cup 14, as also shown in FIG. 1. The molten metal flows through the tapered portion 26 of the sprue cup 14 into the neck portion 22 where it contacts the sprue 18 of the mold pattern 12. The molten metal then melts the foam sprue 18, causing the foam to evaporate, and flows downwardly into the cavity within the compacted process sand 16 as it melts the foam of the mold pattern 12. Eventually, molten metal fills the entire cavity that was once filled by the foam mold pattern 12, and this metal will harden to form the desired casting. When the pouring of the molten metal is completed, molten metalshould also fill the neck portion 22 of the sprue cup 14. This increases the pressure in the metal filling the cavity for a better casting.

The sprue cup 14 has walls of a certain thickness and is made of bonded sand comprising unbound sand having a grain size substantially equal to the grain size of the process sand 16 and a binder that forms a certain percentage of the bonded sand. A typical binder percentage is 3 percent by weight. Factors that must be considered in choosing the binder percentage include the temperature and density of the molten metal being poured, the wall thickness of the sprue cup 14, and how long the sprue cup 14 is to remain intact (or how long the pour will take). The wall thickness of the sprue cup 14 and the binder percentage are chosen, considering the temperature and density of the metal to be poured, so that the bonded sand of at least the neck portion 22 of the sprue cup 14 breaks down under the heat of metal flowing through the cup 14 and resident metal remaining in the cup 14 after the casting process is completed, thereby leaving essentially unbound sand that does not contaminate the unbound process sand 16.

If the binder percentage is too low, the sprue cup 14 will break down before the pour is completed, and sand from the broken down sprue cup 14 will become mixed in the casting. If the binder percentage is too high, the sprue cup 14 will not break down at all.

The dimensions of the sprue cup 14, other than the wall thickness, are determined by, among other things, the volume of the mold pattern 12 and the diameter of the sprue 18 of the mold pattern 12. The inside diameter of the neck portion 22 must be substantially equal to the diameter of the sprue 18, so that the sprue 18 fits snuggly into the neck portion 22. The shape of the main and tapered portions 24 and 26 of the cup portion 20 are not important, except that the volume of molten metal that can be contained by the cup portion 20 of the sprue cup 14 must be enough so that the sprue cup 14 does not run dry during the pouring of the molten metal. If the sprue cup 14 runs dry during the pouring of the metal, so that the level of the metal is below the cup 14 and a portion of the cavity once filled with foam is empty, the unsupported unbound process sand surrounding that portion of the cavity can callapse and ruin the casting.

A sprue cup 14 having a volume equal to 15 percent of the volume of the mold pattern 12 is usally sufficient for preventing the cup from running dry. When molten metal is poured into the sprue cup 14 at the proper rate (this can be done, for example, manually or by a programmable ladler), the sprue cup 14 is filled with molten metal and then maintained substantially full during most of the pour. However, at a point near the end of the pour, there can be a surge in the flow of metal from the sprue cup 14 into the mold pattern 12. If the sprue cup 14 is not substantially full when this surge takes place, the sprue cup 14 will run dry and the casting will be lost. Therefore, the volume of the sprue cup 14 should be such that, when the surge takes place, and if the sprue cup 14 is substantially full, the volume of molten metal in the sprue cup 14 will be enough so that the sprue cup 14 will not run dry. For this reason, the volume of the cup portion 20 of the sprue cup 14 is also referred to as the surge volume.

The other important dimension of the sprue cup 14 is the length of the neck portion 22. The neck portion 22 should be long enough so that the flow of the metal adjacent the unbound process sand 16 beneath the cup 14 is laminar when the foam of the sprue 18 melts beneath the lower end of the neck portion 22. This is because if the flow of metal adjacent the unbound process sand 16 is turbulent, the turbulent metal will dislodge the compacted unbound process sand 16 and the dislodged sand will be included in the casting. In order to prevent this, by providing laminar flow when the foam melts beneath the lower end of the neck portion 22, the neck portion 22 should be long enough so that a sufficient pressure head builds up in the metal before the foam melts beneath the lower end of the neck portion 22. Factors to be considered in determining a sufficient neck portion length include the temperature and pouring rate of the metal and the length of the sprue 18 extending into the neck portion 22.

A casting process utilizing the sprue cup 14 of the invention and carrying out the method of the invention is performed as follows. After the mold pattern 12 and attached sprue cup 14 are surrounded by unbound process sand 16, molten metal is poured into the sprue cup 14. The metal will begin to melt the foam of the sprue 18 while the sprue cup 14 fills with molten metal. If the neck portion 22 is long enough, by the time the foam sprue 18 melts beneath the lower end of the neck portion 22, a sufficient pressure head will have built up in the molten metal so that the flow of the metal adjacent the unbound process sand beneath the neck portion 22 is laminar. The metal is continuously poured throughout the process at a rate sufficient to keep the sprue cup 14 substantially full. The metal continues to melt and evaporate the foam of the sprue 18 and mold pattern 12 until the cavity once occupied by the foam mold pattern 12 is occupied by molten metal. At some point near the end of the pour, a surge in the flow of molten metal into the mold pattern 12 will take place, and the sprue cup 14 will be partially but not completely emptied, assuming the surge volume of the sprue cup 14 is sufficiently great. When the pour is completed, the neck portion 22 of the sprue cup 14 will be substantially filled with molten metal.

Throughout the pouring of the molten metal, the binder in the bonded sand of the sprue cup 14 begins to break down under the heat of the molten metal flowing through the sprue cup 14. However, if the binder percentage is great enough in light of the density and termperature of the metal and the length of the pour, the binder will remain intact until the pour is completed. Afterward, due to the heat received during the casting process, the binder in the neck portion 22 and possibly other portions of the sprue cup 14 breaks down, thereby leaving essentially unbound sand that mixes with the unbound process sand 16 without contamination.

Any portion of the sprue cup 14 that does not break down can be removed from the process sand 16 during the normal culling process. The sand from the sprue cup 14 that does mix with the process sand 16 helps to offset the natural loss of process sand that occurs during other casting steps, especially during the step of removing the casting from the mold flask 10.

Various of the features of the invention are set forth in the following claims.

I claim:

1. A disposable sprue cup for use in a metal casting process using a mold pattern surrounded by unbound foundry sand, which process includes the step of pouring molten metal into the sprue cup, said disposable sprue cup comprising bonded foundry sand consisting essentially of unbound foundry sand having a grain size substantially equal to the grain size of the foundry sand surrounding the mold pattern, and a binder that remains intact until after the pouring is completed and then breaks down under the heat received during the casting process.

2. A disposable sprue cup in accordance with claim 1 wherein said cup comprises an enlarged cup portion adapted to receive molten metal, and an elongated neck portion which extends downwardly from said cup portion when said sprue cup is oriented for casting and which is adapted to be attached to the sprue of a mold pattern such that molten metal received in said cup portion flows within said neck portion to the spruce of the mold pattern.

3. A disposable sprue cup in accordance with claim 2 wherein said neck portion has a cross-sectional area, and wherein said cup portion includes a main portion having a cross-sectional area substantially greater than the cross-sectional area of said neck portion and a tapered portion integrally connected between said main portion and said neck portion.

4. A disposable sprue cup in accordance with claim 2 wherein said elongated neck portion includes a lower end which is adapted to be attached to the sprue of a foam mold pattern by extending the sprue through said lower end into said neck portion.

5. A disposable sprue cup in accordance with claim 4 wherein said neck portion has a length, said length of said neck portion being such that, when metal is poured into said sprue cup and the foam of the sprue melts beneath said lower end of said neck portion, the flow of metal adjacent the unbound sand is laminar.

6. A disposable sprue cup for use in a metal casting process using a mold pattern surrounded by unbound sand having a grain size, which process includes the step of pouring molten metal into the sprue cup, said disposable sprue cup having walls of a predetermined thickness and comprising bonded sand consisting essentially of unbound sand having a grain size substantially equal to the grain size of the sand surrounding the mold pattern and a binder that forms a predetermined percentage of said bonded sand, said wall thickness and said binder percentage being such that said bonded said remains intact until after the pouring is completed and then breaks down under the heat received during the casting process, thereby leaving essentially unbound sand that does not contaminate the unbound sand surrounding the mold pattern.

7. A disposable sprue cup in accordance with claim 6 wherein said cup comprises an enlarged cup portion adapted to receive molten metal, and an elongated neck portion extending downwardly from said cup portion when said sprue cup is oriented for casting and adapted to be attached to the sprue of a mold pattern such that molten metal received in said cup portion flows within said neck portion to the sprue of the mold pattern.

8. A disposable sprue cup in accordance with claim 7 wherein said neck portion has a cross-sectional area, and wherein said cup portion includes a main portion having a cross-sectional area substantially greater than the cross-sectional area of said neck portion and a tapered portion integrally connected between said main portion and said neck portion.

9. A disposable sprue cup in accordance with claim 7 wherein said elongated neck portion includes a lower end and is adapted to be attached to the sprue of a foam mold pattern by extending the sprue through said lower end into said neck portion.

10. A disposable sprue cup in accordance with claim 9 wherein said neck portion has a length, said length of said neck portion being such that, when metal is poured into said sprue cup and the foam of the sprue melts beneath said lower end of said neck portion, the flow of metal adjacent the unbound sand is laminar.

11. A casting process comprising the steps of fabricating a disposable sprue cup consisting essentially of bonded sand including a binder and unbound sand, the sprue cup including an enlarged cup portion adapted to receive molten metal and an elongated neck portion extending downwardly from the cup portion when the sprue cup is oriented for casting, attaching the sprue cup to a foam mold pattern having a sprue by extending the sprue into the neck portion of the sprue cup, embedding the foam mold pattern and a portion of the attached sprue cup in unbound sand, and pouring molten metal into the sprue cup so that the molten metal received in the cup portion flows within the neck portion to the sprue of the mold pattern, whereby, after completion of said pouring step, the binder of the sprue cup disintegrates in response to heat received during the casting process, thereby leaving essentially unbound sand that does not contemminate the unbound sand embedding the foam mold pattern.

12. A process in accordance with claim 11 wherein said pouring step includes pouring at a predetermined rate molten metal having a predetermined temperature into the sprue cup so that the molten metal flowing within the neck portion melts the sprue of the mold pattern, wherein said attaching step includes extending a predetermined length of the sprue into the neck portion of the sprue cup, and wherein said fabricating step includes fabricating the sprue cup such that the neck portion has a length, the length of the neck portion, the length of the sprue extended into the neck portion, and the temperature and pouring rate of the metal being such that, when the foam of the sprue melts beneath the lower end of the neck portion in response to said pouring step, the flow of metal adjacent the unbound sand is laminar.

13. A casting process comprising the steps of fabricating a disposable sprue cup consisting essentially of unbound foundry sand and a binder which binds together the foundry sand until the binder disintegrates under heat, attaching the sprue cup to a foam mold pattern, embedding the mold pattern and a portion of the attached sprue cup in unbound foundry sand, and pouring molten metal into the sprue cup so that the molten metal flows to the mold pattern, whereby, after completion of the pouring step, the binder of the sprue cup disintegrates in response to heat received during the casting process, thereby leaving essentially unbound foundry sand that mixes with and does not contaminate the unbound foundry sand embedding the mold pattern.

* * * * *